United States Patent [19]

Ellingboe

[11] Patent Number: 4,637,526

[45] Date of Patent: Jan. 20, 1987

[54] THEFT RESISTANT CONDIMENT CONTAINER

[76] Inventor: Edmund G. Ellingboe, Rte. 3, Belgrade, Minn. 56312

[21] Appl. No.: 827,634

[22] Filed: Feb. 10, 1986

[51] Int. Cl.[4] ..... B67D 5/62; A47K 1/08

[52] U.S. Cl. ..... 222/146.2; 222/191; 222/164; 294/32; 248/311.2; 248/551

[58] Field of Search ..... 222/191, 465 R, 179.5, 222/160, 164, 129, 142.1–142.4; 211/4, 71; 248/551–553, 205.1, 500, 311.2, 311.3, 313; 294/32; D7/52, 55, 58

[56] References Cited

U.S. PATENT DOCUMENTS

| | | | |
|---|---|---|---|
| 110,473 | 12/1870 | Kennedy | 222/142.4 X |
| 2,069,363 | 2/1937 | Gragg | 222/142.2 |
| 2,210,972 | 8/1940 | Christenson | 211/71 |
| 2,395,613 | 2/1946 | Crowell | 222/129 X |
| 2,591,716 | 4/1952 | Murphy | 222/191 X |
| 3,147,891 | 9/1964 | Fielitz | D7/55 X |
| 4,123,922 | 11/1978 | Kuenstler | 211/4 X |
| 4,418,819 | 12/1983 | Shapiro | 222/142.3 X |
| 4,505,059 | 3/1985 | Morris | D7/55 X |

*Primary Examiner*—Joseph J. Rolla
*Assistant Examiner*—Gregory L. Huson
*Attorney, Agent, or Firm*—Kinney & Lange

[57] ABSTRACT

A theft resistant condiment dispenser for dispensing such condiments as salt and pepper. There is a first box-like support member which is secured to a table by a flexible member which permits movement of the box-like member around a table but which prevents its removal from the table. The box-like support member in turn supports a second support member to which the condiment containers are secured. This second support member is in turn secured by another elongate flexible member to the box-like member. If it is desired to dispense either one or the other of two condiments selectively, provision is made for reversing the position of one of the dispensers with respect to the other so that by proper manipulation either of two condiments can be selectively dispensed.

8 Claims, 5 Drawing Figures

THEFT RESISTANT CONDIMENT CONTAINER

BACKGROUND OF THE INVENTION

1. Field of the Invention.

The present invention is concerned with a theft resistant condiment dispenser for dispensing such condiments as salt and pepper.

2. Description of the Prior Art.

Restaurants are often bothered with the theft of salt and pepper shakers. A typical salt and pepper shaker is easily removed from the table and can be placed readily in a pocket or purse. While the value of any individual salt or pepper shaker is normally relatively small, the continuous theft of these salt and pepper shakers can greatly add to the expense of a restaurant.

The Stickles et al U.S. Pat. No. 2,174,142 shows an arrangement for discouraging the theft of a salt and pepper shaker. In this device, there is a container on which a condiment dispenser is placed, this container being screwed to the table top. The condiment dispenser is in turn connected to the container by a retractable tape which is normally supported by a retractable reel. While the Stickles et al arrangement would hinder the theft of salt and pepper shakers, it has several drawbacks. In the first place, the overall support is rigidly fastened to the table and cannot be moved with respect to it. Furthermore, the fact that the condiment dispensers are secured to a tape which is subject to being rewound by a spring makes it more difficult to maneuver the condiment dispensers. In addition, the two condiment dispensers are integral with each other and it is very difficult to control which condiment will be dispensed.

While there have been numerous arrangements developed for preventing the theft of valuable devices, such as suitcases, radios and so forth, none of these are particularly applicable to preventing the theft of condiment dispensers.

SUMMARY OF THE INVENTION

The present invention is concerned with a theft resistant condiment dispenser in which there is a support for the condiment dispenser which can be readily moved around. The device cannot be readily removed from a table since it is secured to the table by an elongated flexible member which still permits the main support to be moved to different positions with respect to the table. Furthermore, the condiment dispenser is secured on a second support member which can be moved with respect to the first support member and manipulated to dispense a condiment at the desired location. In addition, the invention contemplates having a means for changing the angular position of two condiment dispensers with respect to each other so that condiment from one or the other can be selectively dispensed.

The first support member is preferably secured to the table by a flexible member such as a cable which has a loop large enough to surround a typical table leg. This permits the support member to be moved around the table and yet not be removed from it. There is a second support member for actually supporting the condiment receptacles which in turn is secured by a second flexible member to the first support member, the second flexible member being sufficiently long that the second support member can be removed from the first one and manipulated to move the condiment receptacles to the desired point of use on the table and to be tipped to dispense the condiment at the desired location.

Various other features of the invention will be apparent from a consideration of the accompanying specification, claims and drawing.

DETAILED DESCRIPTION OF THE PREFERRED EMBODIMENTS

Figures 1, 2, 3, 4, 5:
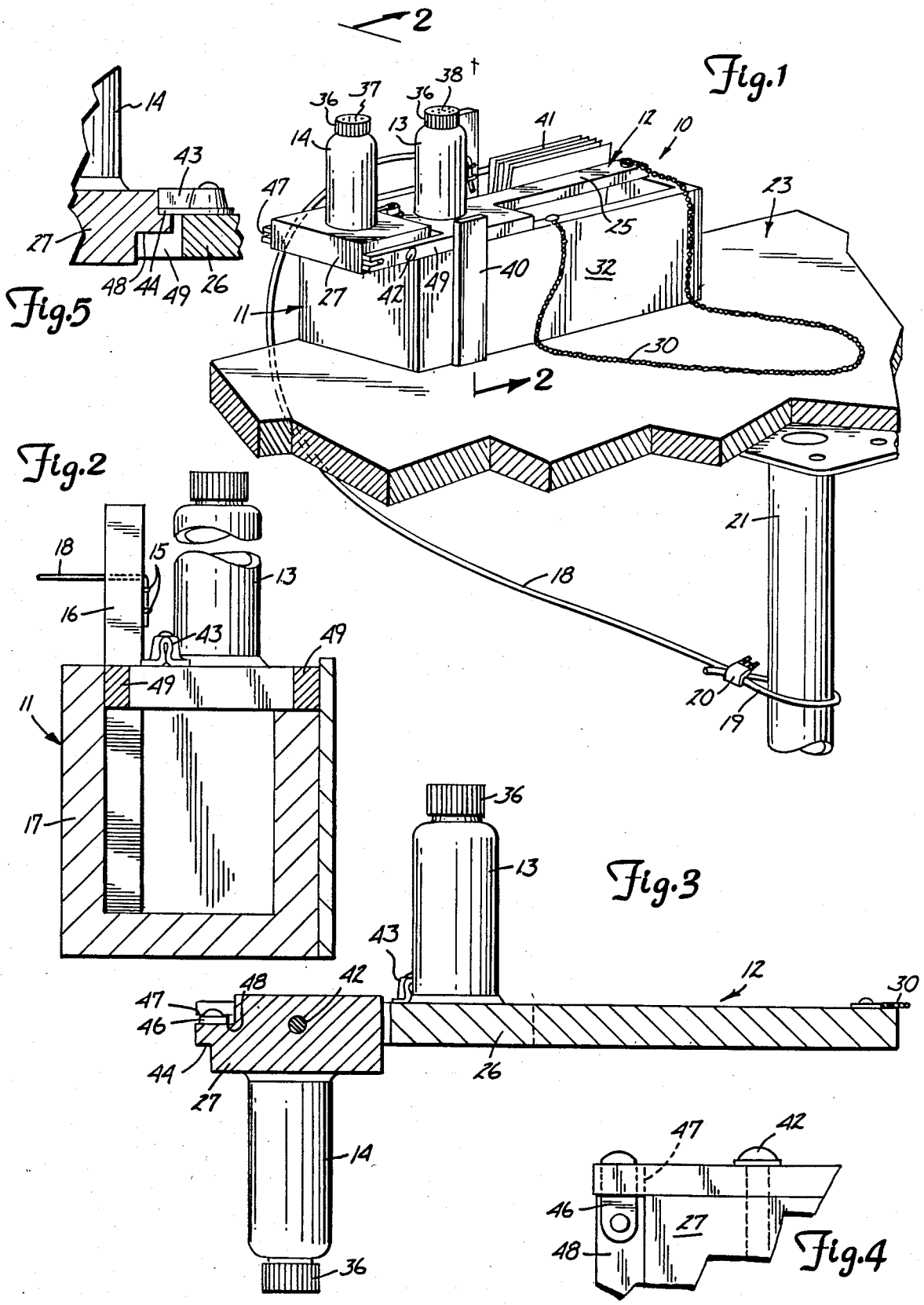
FIG. 1 is a perspective view of the theft resistant condiment dispenser resting on a table to which it is secured, with portions of the table broken away to show the manner in which the condiment dispenser is secured to the table.
FIG. 2 is a sectional view taken along the line 2—2 of FIG. 1.
FIG. 3 is a sectional view of one of the condiment containers rotated 180° to a position in which condiment can be shaken out of either one or the other of two containers.
FIG. 4 is a detail view showing the manner in which one of the condiments holders is locked in an inverted position when it is desired to select one or the other of the two condiments.
FIG. 5 is a detail view showing the manner in which the two condiment receptacle portions are normally held so that both dispensers are upright.

Referring to FIG. 1, the numeral 10 is used to designate my improved condiment dispenser. This comprises a bottom support member 11, which is shown as a form of a box. It is this support member 11 which rests upon and is secured to a table, as will be described later. Secured on top of the first support member 11 is a second support member 12 to which are fastened two condiment dispensers 13 and 14.

A post 16 is secured to a side wall 17 of the first support member 11. The post 16 may be secured in any suitable manner, such as by screws or a suitable adhesive, to the side wall 17. Fastened to the post 16 is a cable 18. The cable 18 is rigidly secured to the post 16 in any suitable maner, as by being passed through an aperture in the post 16 and secured by staples 15. The cable 18, as best shown in FIG. 1, terminates at its opposite end in a loop 19 which is formed by doubling back part of the cable 15 and fastening the doubled back end to the cable by a cable clamp 20. As is also apparent from FIG. 1, the loop 19 is designed to go over a leg 21 of a table 23 upon which the support member 11 rests. The size of the loop 19 can be adjusted to conform with any size table leg by loosening the cable clamp 20 and making a suitable adjustment of this loop.

It will thus be seen that the lower support member 11 is fastened to the table 23 so that it cannot be removed except by lifting the table up and slipping the loop 19 off of the lower end of the leg 21. This would be very obvious and a restaurant customer would be unlikely to take this action.

It will be readily apparent that the support 11 can be moved around a table. In practice, the post 16 is sufficiently long to act as a handle to permit the support member 11 to be readily picked up and moved to a different location.

Referring now to the second support member 12, this support member has three portions. In the first place, it includes a relatively narrow handle portion 25, it also includes a portion 26 (see FIG. 3) rigidly secured to the handle portion 25 and designed to support the condiment receptacle 13. In addition, the support member 12 includes a second condiment receptacle support portion 27 designed to support the condiment receptacle 14.

The second support member 12 is attached to the first support member by a flexible cable or chain 30 which is fastened at one end to the top of a side wall 32 of the first support member 11 and is fastened at its other end to the handle portion 25 of the first support member, as best shown in FIG. 1.

Since the first support member 11 is secured to the table leg 21 in the manner in which it has been described, and the second support member is secured to the first member by means of the cable or chain 30, it is impossible to remove the second support member 12 from the table. The two condiment holders 13 and 14 are securely fastened to the second support member 12. One method of securing them is to have their lower ends extend into apertures in the support member with a suitable cement to hold the condiment receptacles against removal.

The condiment receptacles are provided in the customary manner with removable caps 36 which have apertures 37 and 38 to enable the condiment to be shaken out. The caps 36 are removable so that even though the condiment receptacles 13 and 14 are permanently fastened to the support member 12, they can be refilled with the desired condiment such as salt and pepper.

Normally, the first support member 11 is resting upon the top of the table 23 and the second support member 12 is resting upon the first support member. The handle portion 25 is sufficiently long as to rest on one end wall of the box-like support member 11 while the condiment receptacle support portion 27 rests upon the opposite end wall of the first support member 11. The support member 12 is held against sidewise movement by the post 16 previously described, and by an auxiliary strip 40 which is fastened to the side wall of the support member 12 opposite to the side to which the post 16 is secured. Support member 12 is thus held between the two opposed posts 16 and 40, and will not slip sidewise.

The first support member 11, as previously described, is in the form of a box and this box may be used not only for supporting the second support member 12, but also for supporting other items to be placed upon the table. For example, napkins 41 can be placed within the container between the handle portion 25 and the edge wall of the container.

When it is desired to dispense condiments, the handle 25 is grasped and the entire support member 12 is lifted and turned to the desired angle to dispense the condiments in containers 13 and 14. The handle 25 can be shaken to dispense the condiments. With the condiment containers in the position shown in FIG. 1, both condiments will be dispensed simultaneously.

Normally, it is desirable to selectively dispense one or the other of the condiments in condiment containers 13 and 14. To enable this to be done, portion 27 of support member 12 to which the condiment container 14 is secured is pivotally mounted on support member 12, the pivot being indicated by the reference numeral 42. Portion 27 is normally held against turning by a pivoted latch 43 which, when in locking position, engages a ledge 44 of the condiment receptable support section 27. This ledge is best shown in FIG. 5. The ledge is also shown inverted in FIG. 3.

The pivoted member 46 is locked by the latch against rotation in either direction. Any tendency of the portion 46 to to rotate in a counterclockwise direction is obviously resisted by the extending portion of the latch member 43 which overlies the ledge 44. Because the latch member 43 abuts against the vertical wall extending upwardly from the ledge 44, the supporting portion 27 cannot be rotated clockwise since this vertical wall abuts against the end of the latch member 43. Thus, normally the pivoted portion 46 is held firmly against rotation. When, however, it is desired to selectively use either condiment holder 13 or 14, the pivoted latch 43 is moved to a position in which it no longer overlies the ledge 44. It is then possible to swing the portion 27 to the position shown in FIG. 3. A further swingable latch 46 is provided for retaining the member 27 in the inverted position. As best shown in FIGS. 1 and 2, the support member has two spaced arms 49 about which the member 27 is journaled. The pivot pin 42 extends through the two arms 49 and through the body of the support portion 27. The ends of the arms 49 are provided with slots 47.

The rotatable block 27 is provided with a second ledge 48 which opposes the ledge 44 previously referred to. In the normal position of the portion 27, this shoulder 48 is on the underside of the block. Pivotally secured on this shoulder 48 is the second latching member 46 which is relatively flat. When the supporting portion 27 is rotated 180° to the position shown in FIG. 3, it is possible for the latching member 46 to be moved into the adjacent slot 47. This is best shown in FIG. 4. When this happens, the member 27 is firmly locked in position and cannot be rotated. It is now possible to take hold of the support member 12 by the handle 25 and manipulate the support member 12 so that either the condiment dispenser 13 is down or the condiment dispenser 14 is down. When the condiment 14 is down, as shown in FIG. 3, condiment can be readily shaken out of dispenser 14. When the element 12 is rotated about its longitudinal axis, however, so as to bring the condiment dispenser 13 into the lowermost position and the condiment dispenser 14 in its uppermost position, condiment can be shaken out of condiment dispenser 13. It is thus possible to readily select whether condiment is going out of the dispenser 13 or the dispenser 14. It is to be understood, however, that when one wishes to shake condiment out of both dispensers 13 and 14, the dispensers are left in the position shown in FIG. 1.

With my improved arrangement, it is possible, even though condiment dispensers 13 and 14 are held in position so that they cannot be stolen, to selectively decide whether condiment is to be dispensed out of one or the other of the two dispensers. The usual use of such condiment dispensers is, of course, with salt and pepper, and the user often desires either salt or pepper. At least, the user wants to selectively control how much salt and pepper is used. With the arrangement I have provided, it is possible to do this even though the elements are all held in position and cannot be taken from the table or lifted individually.

CONCLUSION

It will be seen that I have provided a theft proof condiment dispenser in which it is possible to select which of two condiments are to be used and to readily control the relative amounts of the condiments that are used. While my condiment shaker is relatively theft proof, it can be moved around the table readily and the holder for the individual salt and pepper shakers can be readily moved to any desired location on the table. Of course, if the table is an extremely long table, it may be necessary to employ two dispensers of the type which I provide.

While I have shown a specific embodiment of the invention for purpose of illustration, it is to be understood that my invention is limited solely by the scope of the appended claims.

What is claimed is:

1. A theft resistant condiment dispenser comprising:

a first support member designed to rest upon the top of a table;

a first elongated flexible member having one portion secured to the first support member and having a spaced end portion in the form of a loop sufficiently large to surround a typical table leg, the flexible member being effective when the loop is so engaged over a table leg to prevent ready removal of the support member from the table supported by the leg;

a second support member normally supported by said first support member;

a condiment receptacle having apertures adjacent the top thereof for dispensing a condiment when the receptacle is tipped sufficiently, the condiment receptacle being fixedly secured to the second support member; and a second flexible member fastened at its opposite ends to the first and second support members, the second flexible member being sufficiently long that the second support member can be removed from the first support member and actuated to move the condiment receptacle secured thereto to the desired point of use on a table and to be tipped to dispense the condiment at the desired location.

2. The condiment dispenser of claim 1 in which a portion of the second support member is formed as a handle for facilitating the manipulation of the support member and the condiment receptacle secured thereto.

3. The condiment dispenser of claim 1 in which there are two condiment receptacles secured to the second support member for holding separate condiments such as salt and pepper.

4. The condiment dispenser of claim 3 in which means are provided for changing the relative angular position of the condiment receptacles so that by proper manipulation of the second support member, condiment can be selectively dispensed from either of the two condiment receptacles.

5. The condiment dispenser of claim 3 in which one of the condiment receptacles is pivotally secured to the second support member and in which there is a first releasable latching means for normally holding the one condiment receptacle in the same angular position as the other condiment receptacle and a second releasable latching means for holding the one condiment receptacle in a different angular position when the first latching means is released and the one condiment receptacle is moved to said different angular position.

6. A condiment dispenser for dispensing one of or both of two condiments, such as salt and pepper, said dispenser comprising:

a pair of condiment receptacles, each having apertures adjacent the top thereof for dispensing the condiments when the receptacle is tipped sufficiently;

a support member having a handle portion and two condiment receptacle supporting portions, one of the supporting portions being fixed and the other being pivotally mounted on the support member;

means for securing one of the condiment receptacles to the first supporting portion of the support member and for securing the other of the condiment receptacles to the pivotally mounted supporting portion so that upon changing the angular position of the pivotally mounted portion and by proper manipulation of the support member by actuation of the handle portion, condiment can be selectively dispensed from either of the two condiment receptacles; and retaining means for retaining the pivotally mounted portion in either a first position in which the condiment receptacle secured thereto is in the same angular position as the other condiment receptacle or in a second position angularly displaced from the first position.

7. The condiment dispenser of claim 6 in which the retaining means comprises a releasable latching means.

8. The condiment dispenser of claim 6 in which there is means for preventing the support member from being removed from a table on which it is placed.

* * * * *